United States Patent [19]

Whitlow et al.

[11] Patent Number: 4,961,390

[45] Date of Patent: Oct. 9, 1990

[54] PERFORATED PLUGS FOR AIR HOLES IN A ROTARY COMBUSTOR

[75] Inventors: Graham A. Whitlow, Murrysville; Suh Y. Lee, Monroeville, both of Pa.

[73] Assignee: Westinghouse Electric Corp., Pittsburgh, Pa.

[21] Appl. No.: 476,215

[22] Filed: Feb. 7, 1990

[51] Int. Cl.[5] ..... A47J 36/24; F27B 7/36

[52] U.S. Cl. ..... 110/246; 432/103; 110/346

[58] Field of Search ..... 110/246, 346, 348; 432/103

[56] References Cited

U.S. PATENT DOCUMENTS

| | | | |
|---|---|---|---|
| 4,724,778 | 2/1988 | Healy | 110/246 |
| 4,782,768 | 11/1988 | Lee et al. | 432/103 |
| 4,782,769 | 11/1988 | Lee et al. | 110/246 |

*Primary Examiner*—Henry C. Yuen

*Attorney, Agent, or Firm*—Fred J. Baehr, Jr.

[57] ABSTRACT

Perforated plugs fitted into combustion air holes in a rotary combustor in which combustion air for burning municipal solid waste passes through the perforations to prevent molten aluminum and fines from passing through the perforations and the method of preventing molten aluminum from passing through the perforations using the plugs.

12 Claims, 2 Drawing Sheets

PERFORATED PLUGS FOR AIR HOLES IN A ROTARY COMBUSTOR

BACKGROUND OF THE INVENTION

The invention relates to an incinerator for burning solid municipal waste and more particularly to a rotary combustor for the incinerator in which perforated plugs are placed in the holes which bring combustion air into the rotary combustor but prevent molten aluminum and siftings from passing through the perforations.

Mass burning of solid municipal waste is performed in rotary combustors. The temperature within the combustor, is sufficient to melt aluminum, particularly aluminum beverage cans, which are a common element of the municipal waste and are an aluminum alloy, but will be referred to hereafter as aluminum. The molten aluminum drips through the holes in the rotary combustor which supply the combustion air to burn the waste. The aluminum drippings solidify on sealing surfaces and dampers, damaging the seals and impairing the operation of the control dampers. Even the drippings that solidify on the walls of the wind box requiring frequent removal. Broken glass and other siftings require frequent cleaning and are instrumental in premature failure of bearings and other equipment with close operating tolerances.

SUMMARY OF THE INVENTION

Among the objects of the invention may be noted the prevention of allowing molten aluminum and siftings from exiting the rotary combustor at locations other than the open discharge end.

In general, perforated plugs for air holes in a rotary combustor in which combustion air for burning solid municipal waste is supplied through the air holes in the rotary combustor from a wind box disposed beneath the rotary combustor, when made in accordance with this invention, comprises a plurality of perforated plugs fitting in the holes with an interference fit. The plugs each have a plurality of perforations and the perforations each have an open area in the range of about 3 to 18 square millimeters, whereby the perforations cooperate with combustion air supplied to the rotary combustor through the perforated plugs in the air holes to prevent molten aluminum and fines from passing through the perforations and into the wind box.

BRIEF DESCRIPTION OF THE DRAWINGS

The invention as set forth in the claims will become more apparent by reading the following detailed description in conjunction with the accompanying drawings, wherein like reference numerals refer to like parts throughout the drawings and in which:

DESCRIPTION OF THE PREFERRED EMBODIMENT

Figure 1:
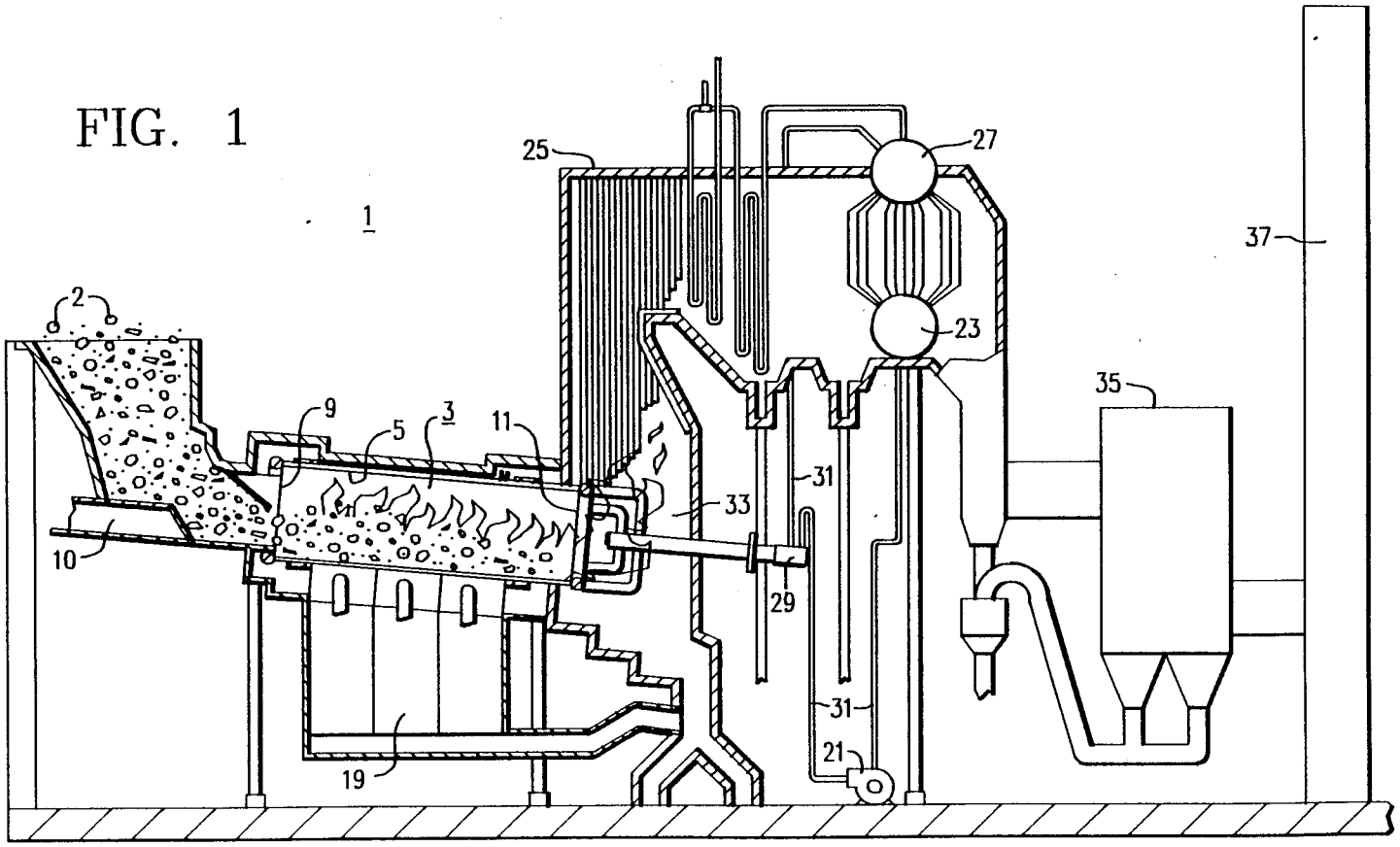
FIG. 1 is a schematic view of a municipal solid waste incinerator.

Referring now to the drawings in detail and in particular to FIG. 1, there is shown an incinerator 1 for burning municipal solid waste 2 in a rotary combustor 3. The rotary combustor 3 is formed from a circular array of tubes or pipes 5 with a plate or web 7 connecting adjacent pipes 5. The web 7 has a plurality of holes 8 through which combustion air is supplied to the rotary combustor 3. The rotary combustor 3 is disposed to rotate on an inclined axis. Waste to be incinerated is fed into an upper or inlet end 9 of the combustor 3 by a ram 13 and tumbles toward a lower or outlet end 11 as the combustor 3 rotates on metal tires, which engage spaced apart rollers (not shown). The plates or webs 7 are perforated to provide holes or perforations 15 which allow combustion air supplied from wind box 19 to enter the bottom portion of the rotary combustor 3. The burning tumbling waste 2 tends to ride up on one side of the combustor 3 as it rotates and the wind box 19 thereunder is disposed to supply combustion air to the underside of the burning waste and is thus called the underfire wind box 19 and the adjacent wind box (not shown) is disposed to supply combustion air over the burning waste and is thus called the overfire wind box. A cooling fluid, water, is circulated through the pipes to keep them and the webs 7 cool and increase their useful life. The water is supplied from a pump 21, which takes its suction from a water drum 23 in a waste heat water wall boiler 25 and returns the heated cooling fluid to a steam drum 27 via a rotary joint 29 and associated piping 31. Unburnables, ash and hot gases exit from the lower end of the combustor 3, the hot gases and some fly ash flow upwardly in a flue portion 33 of the boiler 25, through a filter 35 such as an electrostatic precipitator or other filtering means, which remove the ash, and the hot gases exit out of a stack 37. The heavier ash and unburnables fall into the an ash removal hopper 39 in the bottom portion of the boiler 25.

Figure 2:
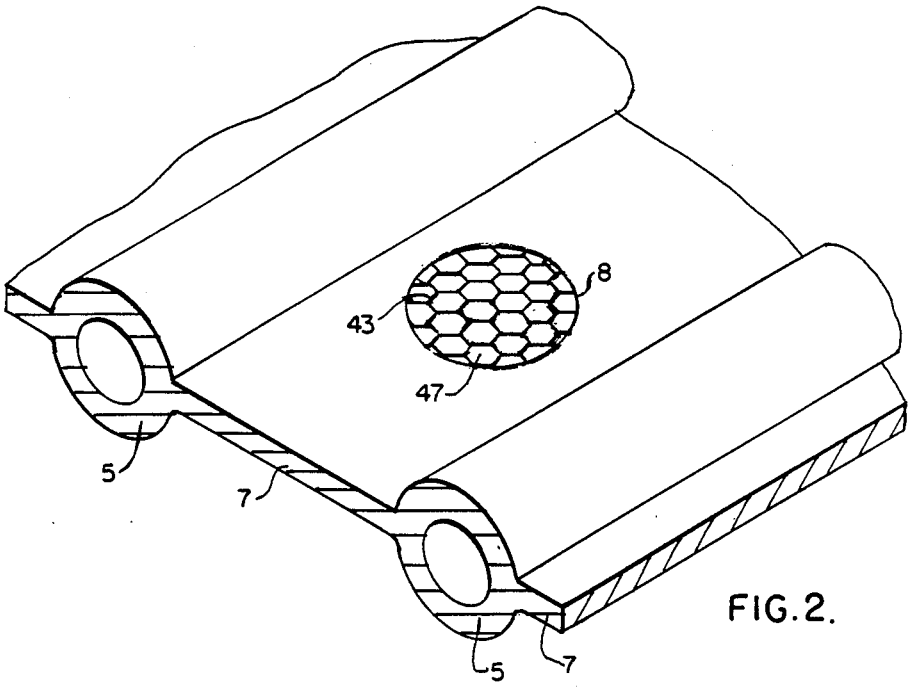
FIG. 2 is a partial sectional view of a rotary combustor with a perforated plug disposed in a combustion air hole.
Figure 3:
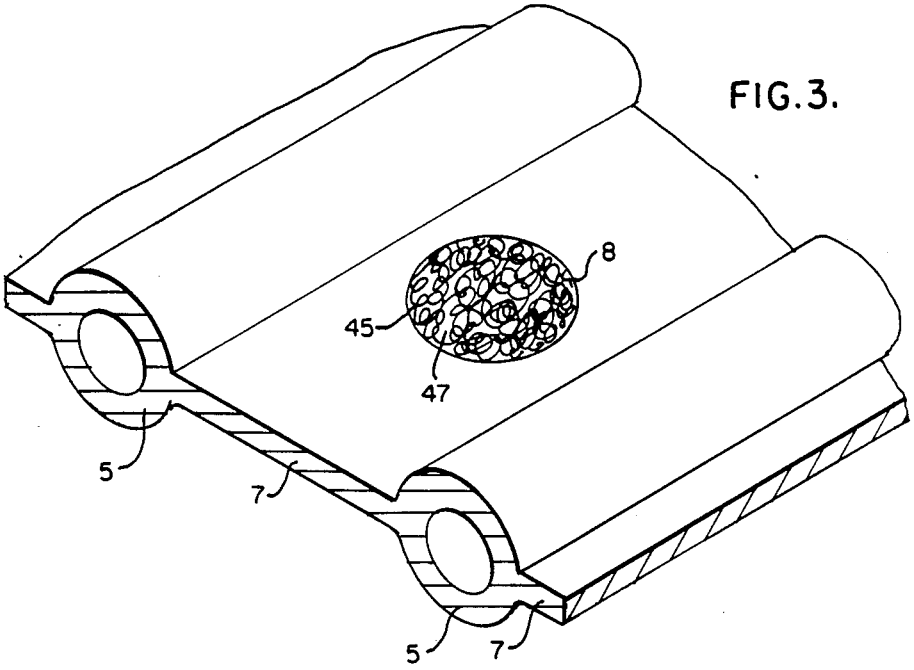
FIG. 3 is a partial sectional view of a rotary combustor with an alternative perforated plug disposed in a combustion air hole.

As shown in FIG. 2 and 3 the holes 8 in the web 7 each have a perforated plug 41 fitted therein. The perforated plugs 41 are sized to form an interference fit with the holes 8 and are made of a material having a coefficient of expansion, which causes the perforated plugs 41 to tighten in the holes 8 as the temperature increases. The perforated plugs 41 are made from slabs of honeycomb 43 or porous 45 heat, erosion and corrosion resistant materials including ceramics, metals and metal alloys including nickel chromium and iron chromium alloys such as Hastelloy X. Honeycomb material, as shown in FIG. 2, is made of metal alloy foil having a thickness in the range of 0.025 to 0.125 millimeters with a thickness of 0.05 millimeter (0.002 inches) being the preferred thickness. While FIG. 2 shows a hexagonal pattern; square, diamond or other geometric patterns can be used. Openings or perforations in the honeycomb 47 are aligned with the holes 8 in the web 7 to assist in minimizing the pressure drop across the honeycomb. The size of the open area of each opening or perforation 47 in the perforated plug 41 is in the range of 1 to 18 square millimeters with about 8 square millimeters being the preferred size of the open area of each perforation 47. The size of the open area cooperates with the surface tension forces of the molten aluminum and the differential pressure of the combustion air across the openings 8 to form a meniscus and allow the aluminum to bridge the opening 47 and prevent the molten aluminum from dripping through the perforations 47. The size of the openings 47 also cooperates with the flow of combustion air through the perforations 47 to prevent broken glass and other siftings or fines from dropping through the perforations 47 without substantially increasing the pressure drop across the combustion air holes 8.

Installing perforated plugs 41 in the air holes advantageously prevents molten aluminum and fines from passing through the perforations averting damage to seals, dampers and other apparatus installed within the wind box 19.

While the preferred embodiments described herein set forth the best mode to practice this invention presently contemplated by the inventors, numerous modifications and adaptations of this invention will be apparent to others skilled in the art. Therefore, the embodiments are to be considered as illustrative and exemplary and it is understood that the claims are intended to cover such modifications and adaptations as they are considered to be within the spirit and scope of this invention.

What is claimed is:

1. Perforated plugs for air holes in a rotary combustor in which combustion air for burning solid municipal waste is supplied through the air holes in the rotary combustor from a wind box disposed beneath the rotary combustor, said perforated plugs fitting in said holes with an interference fit and said plugs having a plurality of perforations, the perforations each having an open area in the range of 1 to 18 square millimeters, whereby said perforations cooperate with combustion air supplied to the rotary combustor through the perforated plugs in the air holes to prevent molten aluminum, and fines from passing through the perforations and into said wind box.

2. Perforated plugs of claim 1, wherein the plugs are made of honeycomb shaped material.

3. Perforated plugs of claim 1, wherein the plugs are made of a porous metal.

4. Perforated plugs of claim 2, wherein the honeycomb material is a metal.

5. Perforated plugs of claim 4, wherein the metal is a corrosion and erosion resistant alloy.

6. Perforated plugs of claim 4, wherein the metal is Hastelloy X.

7. Perforated plugs of claim 1, wherein the plugs are made of a material having a coefficient of expansion which cause the plugs to tighten in the holes at elevated temperatures.

8. Perforated plugs of claim 2, wherein the perforations in the honeycomb are aligned with air holes in the rotary combustor.

9. A method of preventing molten aluminum and fines from passing through the combustion air passages of a rotary combustor utilized to burn solid municipal waste comprising the steps of making perforated plugs which fit tightly into combustion air holes disclosed in the rotary combustor;

making the perforated plugs with a plurality of perforations each of which generally have an open area in the range of about 1 to 18 square millimeters to form a plurality of separate air passages in each combustion air hole;

pressing the perforated plugs into the combustion air openings whereby the perforations cooperate with the combustion air to prevent molten aluminum and fines from passing through the combustion air passages.

10. The method of claim 9, wherein the step of making perforated plugs with a plurality of perforations comprises making the plugs from slabs of honeycomb material.

11. The method of claim 9, wherein the step of making perforated plugs with a plurality of perforations comprises making the plugs for slabs of porous material.

12. The method of claim 10, wherein the honeycomb is made of metal foil having a thickness in the range of 0.025 to 0.125 millimeters.

* * * * *